US007375275B2

(12) United States Patent
Matsuoka et al.

(10) Patent No.: US 7,375,275 B2
(45) Date of Patent: May 20, 2008

(54) ELECTRONIC INSTRUMENT AND REPRODUCTION SYSTEM

(75) Inventors: Kazuhiko Matsuoka, Hamamatsu (JP); Kazuo Kurahashi, Iwata (JP)

(73) Assignee: Roland Corporation, Hamamatsu (JP)

( * ) Notice: Subject to any disclaimer, the term of this patent is extended or adjusted under 35 U.S.C. 154(b) by 54 days.

(21) Appl. No.: 11/441,817

(22) Filed: May 27, 2006

(65) Prior Publication Data

US 2006/0273936 A1 Dec. 7, 2006

(30) Foreign Application Priority Data

May 30, 2005 (JP) ..... 2005-156587

(51) Int. Cl.
*G10H 3/06* (2006.01)
*G10H 7/00* (2006.01)

(52) U.S. Cl. ..... 84/645

(58) Field of Classification Search ..... 84/645
See application file for complete search history.

(56) References Cited

U.S. PATENT DOCUMENTS 4,625,326 A * 11/1986 Kitzen et al. ..... 381/17
5,569,869 A * 10/1996 Sone ..... 84/609
6,737,571 B2 * 5/2004 Furukawa ..... 84/610
2003/0061931 A1 * 4/2003 Ishii et al. ..... 84/645

FOREIGN PATENT DOCUMENTS

JP 06-284383 A2 10/1994
JP 2004-233416 A1 8/2004

* cited by examiner

*Primary Examiner*—Lincoln Donovan
*Assistant Examiner*—Andrew R Millikin
(74) *Attorney, Agent, or Firm*—Foley & Lardner LLP

(57) ABSTRACT

An electronic instrument includes an input device having a plurality of channels to each of which an audio signal is input. A demodulation device demodulates audio signals and converts the audio signals into digital signals that control the electronic instrument. The electronic instrument also includes a feeding device that feeds the digital signals to a sound source and a detection device that detects whether or not the audio signals in any of the plurality of channels are modulated by the digital signals. A controller controls the demodulation device, in cases where it has been detected that any of the audio signals are modulated by the digital signals, so as to demodulate the digital signals from the audio signals that have been input to the channels, such that another channel's audio signals that are not modulated by the digital signals are output to an audio output.

11 Claims, 5 Drawing Sheets

1:Normal
2:Type A
3:Type B

ELECTRONIC INSTRUMENT AND REPRODUCTION SYSTEM

CROSS-REFERENCE TO RELATED PATENT APPLICATIONS

Japan Priority Application 2005-156587, filed May 30, 2005 including the specification, drawings, claims and abstract, is incorporated herein by reference in its entirety.

BACKGROUND OF THE INVENTION

1. Field of the Invention

Embodiments of the present invention relate to an electronic instrument and, in particular, embodiments to an electronic instrument in which an analog signal that is modulated by a digital signal is input, is demodulated, and fed to a sound source.

2. Description of the Related Art

For some time electronic instruments have been known in which Musical Instrument Digital Interface (MIDI) data, which is data that conform to the MIDI standard, (a standard for performance data that carries out instructions such as the starting or stopping of the production of musical tone signals mutually between electronic instruments or between an electronic instrument and a personal computer), is input and a musical tone signal is generated in conformance with the inputted MIDI data. For example, an electronic instruments that conforms to the MIDI standard is disclosed in Japanese Laid-Open Patent Application Publication (Kokai) Number 2002-297132.

In addition, in Japanese Laid-Open Patent Application Publication (Kokai) Number 2004-233416, an electronic instrument is disclosed in which the frequency or the frequency band of an audio signal that has been reproduced using a compact disc (CD) is detected as required and the key of the pitch that corresponds to the frequency or the frequency band that has been detected is pressed down.

In addition, an electronic instrument is presented in which one or the other of the analog signals of the left and right audio channels reproduced by a CD or a digital versatile disc (DVD) and the like is modulated by a digital signal (the MIDI data) and stored. The digital signal is demodulated from the analog signal and converted into MIDI data. The musical tone is produced by driving the keyboard of a piano. The analog signal of the channel which is not modulated by the digital signal is reproduced as a musical accompaniment of the musical tone that is produced by driving the keyboard.

However, problems can be encountered with an electronic instrument in which one or another of the analog signals of the left and right audio channels of a CD and the like is modulated by a digital signal and stored, where this analog signal is demodulated to produce a digital signal that controls a keyboard. For example, whether or not the analog signal is modulated by the digital signal that controls the instrument must be confirmed referring to the CD or to the instruction book that is attached to the CD. The electronic instrument must be set by an operation to either simply reproduce the CD or to control the electronic instrument based on the analog signal that has been modulated and stored in one or the other channel.

In addition, since one of the two left and right channels that are reproduced, on which channel the analog signal is modulated by the digital signal that controls the instrument is different depending on the type of CD and the like, there has been the drawback that it is necessary to make the settings of that type in accordance with the operation. In those cases where the user makes a mistake in the connection with the left and right input channels, the intended operation of the electronic instrument will not be achieved.

In addition, in the past, a reproduction system has not existed with which images and audio signals that have been stored on a DVD and the like are reproduced, where the digital signal like the MIDI data that controls the electronic instrument is demodulated from the audio signal, the electronic instrument is controlled by the control signal that has been demodulated, and the images and musical tones that have been generated by the electronic instrument are synchronized and reproduced.

SUMMARY OF THE INVENTION

Embodiments of the present invention address the problems that have been discussed above and relate to an electronic instrument and reproduction system, the operability of which is satisfactory without the need to perform operations such as carrying out instructions for the demodulation of the analog signal that is modulated by a digital signal that is input.

An instrument in accordance with an embodiment of the present invention includes an input device having a plurality of channels to each of which an audio signal is input and a demodulation device with which the audio signals that have been input by the input device are demodulated and converted into digital signals that control the electronic instrument. A feed device with which the digital signals that have been demodulated by the demodulation device are fed to a sound source. The instrument also includes a detection device that detects whether or not any of the audio signals of the plurality of channels that has been inpute by the input device is modulated by the digital signals that control the electronic instrument. A control device controls the demodulation device when the detection device detects that any of the audio signals of the plurality of channels that has been input by the input device is modulated by the digital signals that control the electronic instrument. The digital signals that control the electronic instrument are demodulated from the audio signals that have been input to the channels, such that other channel's audio signals that are not modulated by the digital signals are output to an audio output.

According to an embodiment of the present invention, the audio signal that is input by the input device is an analog signal. The detection device differentiates the type of the digital signal by detecting which of the analog signals of the plurality of channels that have been input by the input means are modulated by the digital signals. The demodulation device demodulates the digital signal based on the type of digital signal that has been differentiated by the detection device.

According to another embodiment of the present invention, the audio signal that is input by the input device is also an analog signal. However, in cases where the detection has detected that any of the audio signals of the plurality of channels that has been input by the input device is modulated by the digital signal, the detection device differentiates the type of digital signal by detecting the width of the pulse that forms the waveform of the analog signal. The demodulation device demodulates the digital signal based on the type of digital signal that has been differentiated by the detection device.

According to a further embodiment to the present invention, the audio signals that are input by the input device are two, a left and a right, channel audio signals. The instrument includes a pseudo stereo device with which either the left or the right audio signal that has been input by the input device is converted into a pseudo stereo signal. In cases where the fact that the detection device has detected that either the right or the left audio signal that has been input by the input device is modulated by the digital signal that controls the electronic instrument, the control device feeds the audio signal of a channel that is different from the channel in which the analog signal is modulated by the digital signal to the pseudo stereo device.

According to an embodiment of the present invention, the control device includes a delay device with which a digital signal that has been demodulated by the demodulation device is delayed a specified period of time and fed to the sound source.

According to an embodiment of the present invention, the detection device differentiates the type of digital signal by detecting which of the channels of the plurality of channels the analog signals that has been input by the input device is modulated by the digital signal. In cases where the detection device has detected that any of the audio signals of the plurality of channels that has been input by the input device has been modulated by the digital signal, the detection device differentiates the type of the digital signal by detecting a width of the pulse that forms the waveform of the audio signal. The delay for a specified period of time and feed to the sound source is done by the delay device in conformance with the type of digital signal, which has been demodulated by the demodulation device that has been differentiated by the detection device.

According to an embodiment of the present invention the electronic instrument comprises a plurality of keys and a key driving device that drives each key, and the control device carries out control such that the key is driven by the key driving device in conformance with the digital signal that controls the electronic instrument and which has been demodulated by the demodulation device.

A reproduction system according to an embodiment of the present invention includes a reproducing apparatus that synchronizes and reproduces an audio signal and an image signal and an electronic instrument. The electronic instrument includes an input device by which an audio signal that is reproduced by the reproducing apparatus is input, a demodulation device that demodulates a digital signal that controls the electronic instrument and such that the audio signal that has been input by the input device is modulated by said digital signal, and a sound source that forms a musical tone signal in conformance with the digital signal that has been demodulated by the demodulation device. A sound apparatus is provided that emits the musical tone signal that is formed by the electronic instrument and the audio signal that is reproduced by the reproducing apparatus. A display apparatus displays the image signal that is reproduced by the reproducing apparatus.

According to one embodiment of the present invention, the electronic instrument also includes an input device that inputs the audio signals of a plurality of channels from the reproducing apparatus, a detection device that detects whether or not any of the audio signals of the plurality of channels that has been input by the input device is modulated by the digital signals that control the electronic instrument, and a control device that controls the demodulation device when it has been detected by the detection device that any of the audio signals of the plurality of channels that has been input by the input device is modulated by the digital signals that control the electronic instrument, so as to demodulate the digital signals that control the electronic instrument from the audio signals that have been input to the channels, such that the other channel's audio signals that are not modulated by the digital signals are output to an audio output.

According to an embodiment of the present invention the audio signal that is input by the input device is an analog signal, and the detection device differentiates the type of digital signal by detecting which of the channels the analog signal that has been input by the input device is modulated by the digital signals. The demodulation device demodulates the digital signal based on the type of digital signal that has been differentiated by the detection device.

According to another embodiment of the present invention, the audio signal that is input by the input device is an analog signal and in those cases where the detection device has detected that any of the analog signals of the plurality of channels that has been input by the input device is modulated by the digital, the detection device differentiates the type of digital signal by detecting a width of the pulse that forms the waveform of the analog signal, and the demodulation device demodulates the digital signal based on the type of digital signal that has been differentiated by the detection device.

According to a further embodiment of the present invention, the audio signals that are input by the input device are two, a left and a right, channel audio signals and a pseudo stereo device with which either the left or the right audio signal that has been input by the input device is converted into a pseudo stereo signal. In those cases where the detection device detects that either the left or the right audio signal that has been input by the input device is modulated by a digital signal that controls the electronic instrument, the control device feeds the audio signal of a channel that is different from the channel in which the analog signal is modulated by the digital signal to the pseudo stereo device.

According to an embodiment of the present invention, the electronic instrument includes a delay device with which a digital signal that has been demodulated by the demodulation device is delayed a specified period of time and fed to the sound source.

According to an embodiment of the present invention the detection device differentiates the type of the digital signal by detecting which of the channels of the plurality of channels the audio signals that have been input by the input device is modulated by the digital signal, or in those cases where the detection device has detected that any of the audio signals of the plurality of channels that have been input by the input device is modulated by a digital signal, the detection device differentiates the type of digital signal by the width of the pulse that forms the waveform of the audio signal. The delay for a specified period of time and feed to the sound source is performed by the delay device in conformance with the type of digital signal, which has been demodulated by the demodulation device, that has been differentiated by the detection device.

According to a further embodiment of the present invention the electronic instrument comprises a plurality of keys and a keyboard driving device which drives each of the plurality of keys in conformance with the digital signals that control the electronic instrument.

DETAILED DESCRIPTION OF THE PREFERRED EMBODIMENTS

Figure 1:
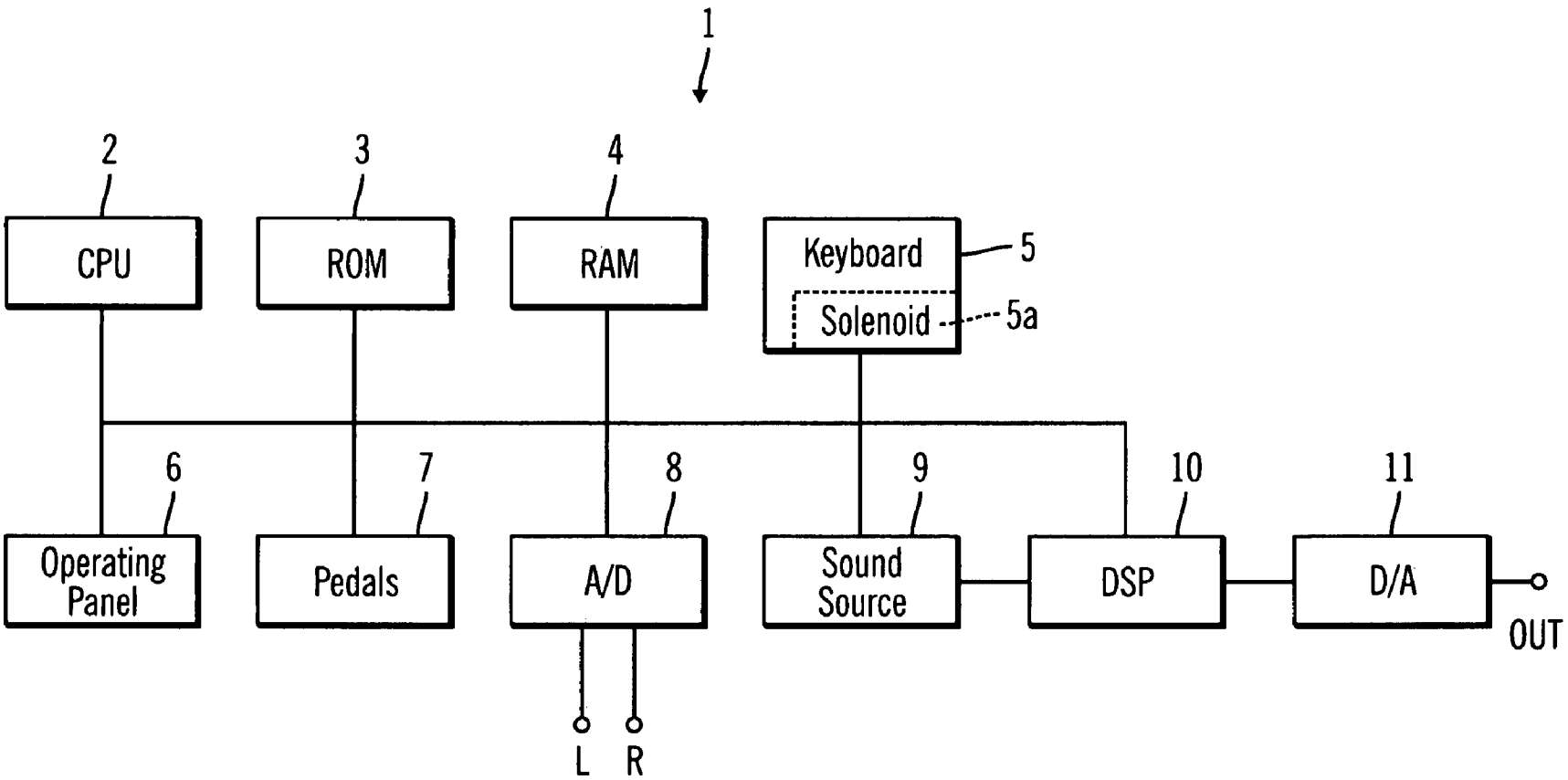
FIG. 1 is a block diagram that shows an electrical configuration of an electronic instrument according to one embodiment of the present invention.

An explanation will be given regarding embodiments of the present invention while referring to the attached drawings. FIG. 1 is a block diagram that shows the electrical configuration of the electronic instrument 1, according to one embodiment of the present invention.

The electronic instrument 1 includes central processing unit (CPU) 2, read only memory (ROM) 3, random access memory (RAM) 4, keyboard 5, operating panel 6, pedals 7, analog to digital (A/D) converter 8, sound source 9 and digital signal processor (DSP) 10 all mutually interconnected by the bus line 50. The output of the DSP 10 is connected to a digital to analog (D/A) converter 11.

The CPU 2 is an arithmetic processing unit and the various types of control programs that are executed by the CPU 2 as well as the fixed value data referred to at the time of the execution are stored in the ROM 3. As for the control programs, these are programs that carry out processing such as the demodulation of an analog signal, which will be discussed later, and the feeding of a demodulated digital signal to the sound source 9. The RAM 4 is configured using a rewriteable memory and is a memory for the temporary storage of various kinds of data for the execution of the control programs stored in the ROM 3 and the like.

The keyboard 5 has a plurality of white keys and black keys. The keyboard 5 outputs the pitch, the key pressing speed, and the key releasing speed in accordance with the keys pressed and the keys released by the operator. Each key is furnished with a solenoid 5*a* and the key is pressed downward by the application of electrical power to the solenoid 5*a*.

The operating panel 6, is positioned in the vicinity of the keyboard 5 and has various types of operators such as knobs and switches and a display device. The parameters of the musical tones are set by the user adjusting the operators and displayed in the display device. The pedals 7 are positioned below the keyboard 5 and placed below the user's foot for easy operation. The operation of a damper and the like is performed by the user stepping on the pedal with a foot.

The normal performance mode and the automatic performance mode are switched to and set by the switches of the operating panel 6. In the normal performance mode, when the user performs and operates the keyboard 5 and the pedals 7, the performance information that corresponds to the performance operation is transmitted to the sound source 9 and the sound source 9 produces or stops the production of the musical tone in conformance with the performance information. On the other hand, in the automatic performance mode, when an audio signal of either the left or right channel that is input from the A/D converter 8 is modulated by a digital signal, the digital signal is demodulated, converted into MIDI data, and transmitted to the sound source 9 and the keyboard. The automatic accompaniment is performed and the analog signal of the other channel is made into a pseudo stereo signal and then outputted.

The sound source 9 produces or stops the musical tones in conformance with the MIDI data input and the keys of the keyboard 5 are pressed or released, driven by the solenoids 5*a* furnished with each key. At this time it is not necessary to form MIDI data by pressing or releasing each key.

The A/D converter 8 samples an analog signal (an audio signal) of the left and right channels, which are input externally, respectively at a specified sampling frequency (for example, 44.1 kHz) and acquires successive amplitude values.

The sound source 9 stores the waveforms for various types of instruments and produces musical tones having a specified pitch, volume, and timbre according to the direction of the CPU 2. In the normal performance mode, the sound source 9 carries out the production and termination of the musical tones having pitches that correspond to the keys that conform to the key pressing and key releasing performance operations using the keyboard 5. In the automatic performance mode, the production and termination of the musical tones are carried out in conformance with the MIDI data that has been converted by the A/D converter 8 and demodulated.

The DSP 10 is a Digital Signal Processor and applies effects such as reverberations and the like to the musical tones that have been generated by the sound source 9 or the amplitude values that have been converted by the A/D converter 8.

In addition, the DSP 10 carries out pseudo stereo processing that makes the monaural signal that is input into a stereo signal. Various kinds of methods are known for accomplishing this processing. For example, a method is known such as that in which the input signal is fed to two delay lines and the phase of the low frequency signal that modulates the readout speed of one of the delay lines is shifted 180 degrees with respect to the phase of the low frequency signal that modulates the readout speed of the other delay line.

The digital signal that has had an effect applied or the digital signal that has been made into a pseudo stereo signal by the DSP 10 is converted into an analog signal and output by the D/A converter 11.

Figure 2A:
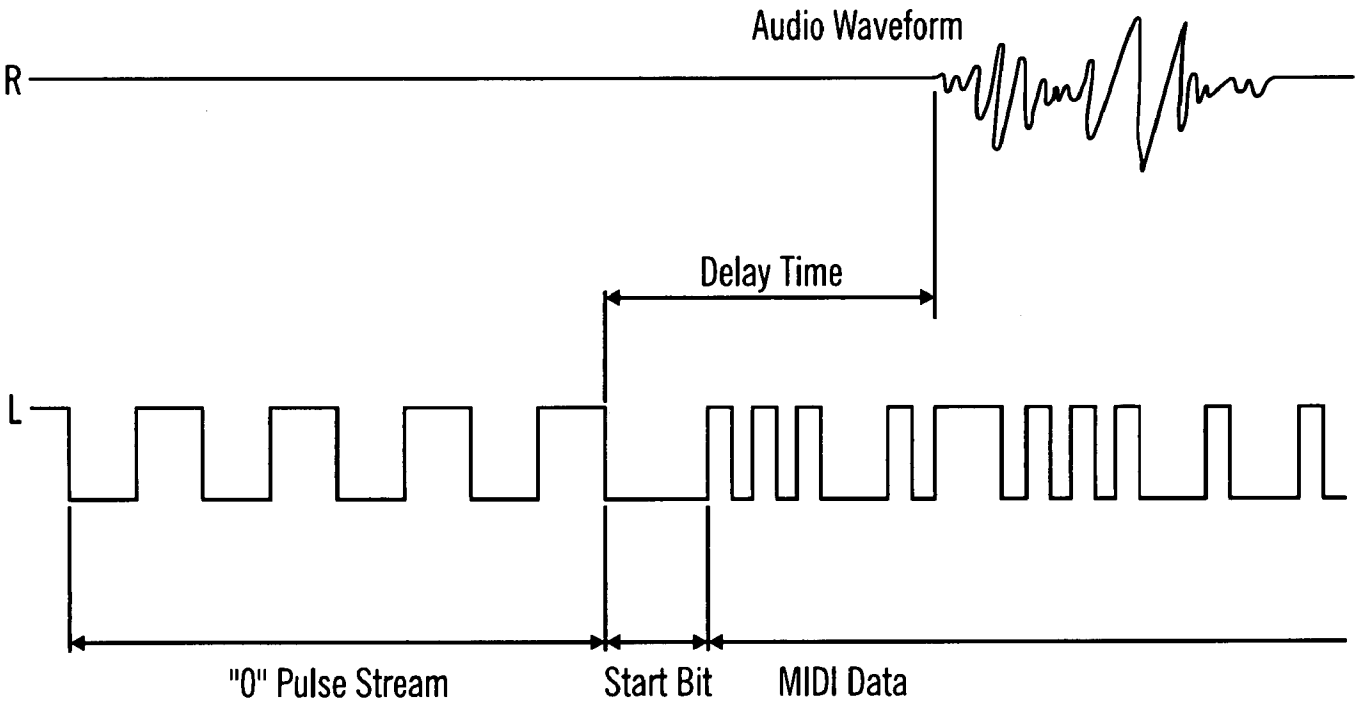
FIG. 2(*a*) is a drawing that shows an input waveforms of the left and right channels and FIG. 2(*b*) is a drawing that shows waveforms that indicate a "0" and a "1" of a bit stream.
Figure 2B:
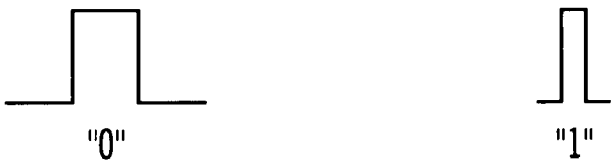

FIGS. 2(*a*) and 2(*b*) shows the analog waveforms of the left and right channels that have been input to the A/D converter 8. As is shown as the R and L in FIG. 2(*a*), in this drawing the case is shown in which an analog signal that has been modulated by a digital signal is input only in the L channel.

Incidentally, whether an analog signal of only the L channel has been modulated by the digital signal or an analog signal of only the R channel has been modulated by the digital signal differs depending on the type.

With the signal of the L channel that has been modulated by the digital signal, normally, following a signal in which "0" is indicated and following a start bit that indicates the start at a specified time, the MIDI data are stored by a pulse stream having pulse widths that indicate "0" or "1." As is shown in FIG. 2(*b*), for "0," the pulse width is wide and for "1," the pulse width is narrow. Here, irrespective of whether the level is high or low, whether the bit is "0" or "1" or a start bit and the like is defined by the length of time from the pulse rise to the pulse fall or the time from the pulse fall to the pulse rise. The value of the pulse width and the start bit, as well as whether there is a start bit or not differs depending on the type. In addition, for the MIDI data also, there are cases in which the data are stored in a unique format that depends on the media and the like rather than a format that is prescribed in accordance with the MIDI standards.

As is shown by the delay from the start time of the start bit to the time until the rise of the audio waveform of the R channel, the MIDI data are stored at a time that is earlier than the time that the audio waveform is reproduced. This is because, in the case of a piano in which the keys are driven in accordance with the Note On message of the MIDI data and the hammer strikes the string in conformance with the pressing down of the key, a period of time (for example, 500 msec) is required from the receiving of the MIDI data until the generation of the musical tone. Since the audio waveform of the R channel is one that carries out the accompaniment to the piano sound, the sound of the piano is later than that of the accompaniment. In order to avoid that condition, the audio waveform is stored at a specified time delayed from the MIDI data. The length of each bit may be on the order of 100 μsec and the delay time may be on the order of 100 msec. In FIG. 2(*a*), the delay time is shown shortened compared to the length of the bits.

Figure 3:
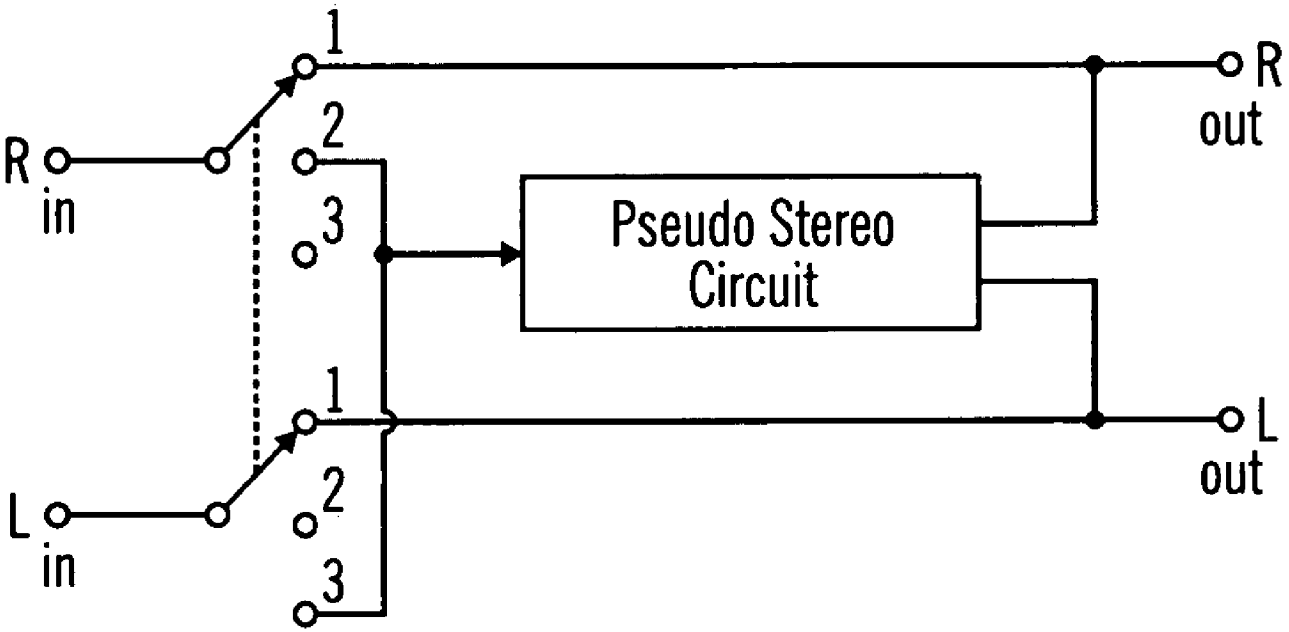
FIG. 3 is a drawing that shows an input cutover switch for a pseudo stereo circuit according to an embodiment of the present invention.

FIG. 3 is a drawing that shows schematically a pseudo stereo circuit that is configured by the DSP 10. The case in which any of the analog signals that have been input in the left and right channels are not modulated by the digital signal is made the normal type, the case in which only the input of the left channel is modulated by the digital signal is made the A type, and the case in which only the input of the right channel is modulated by the digital signal is made the B type. The case has been shown in which a cutover switch is employed for the selection of the input of which one of the left and right channels is input to the pseudo stereo circuit.

Since, in the case of the normal type, the signals that have been input are the left and right analog signals that have been input, the cutover switch is set to position 1 and the audio output is output without either of the inputs being fed to the pseudo stereo circuit.

In the case of the A type, since the input of the left channel is modulated by the digital signal, the cutover switch is set in position 2, the input of the left channel is not connected to either and is muted while the input of the right channel is input to the pseudo stereo circuit. In the case of the B type, since the input of the right channel is modulated by the digital signal, the cutover switch is set in position 3, the input of the left channel is input to the pseudo stereo circuit and the input of the right channel is not connected to either and is muted.

Figure 4:
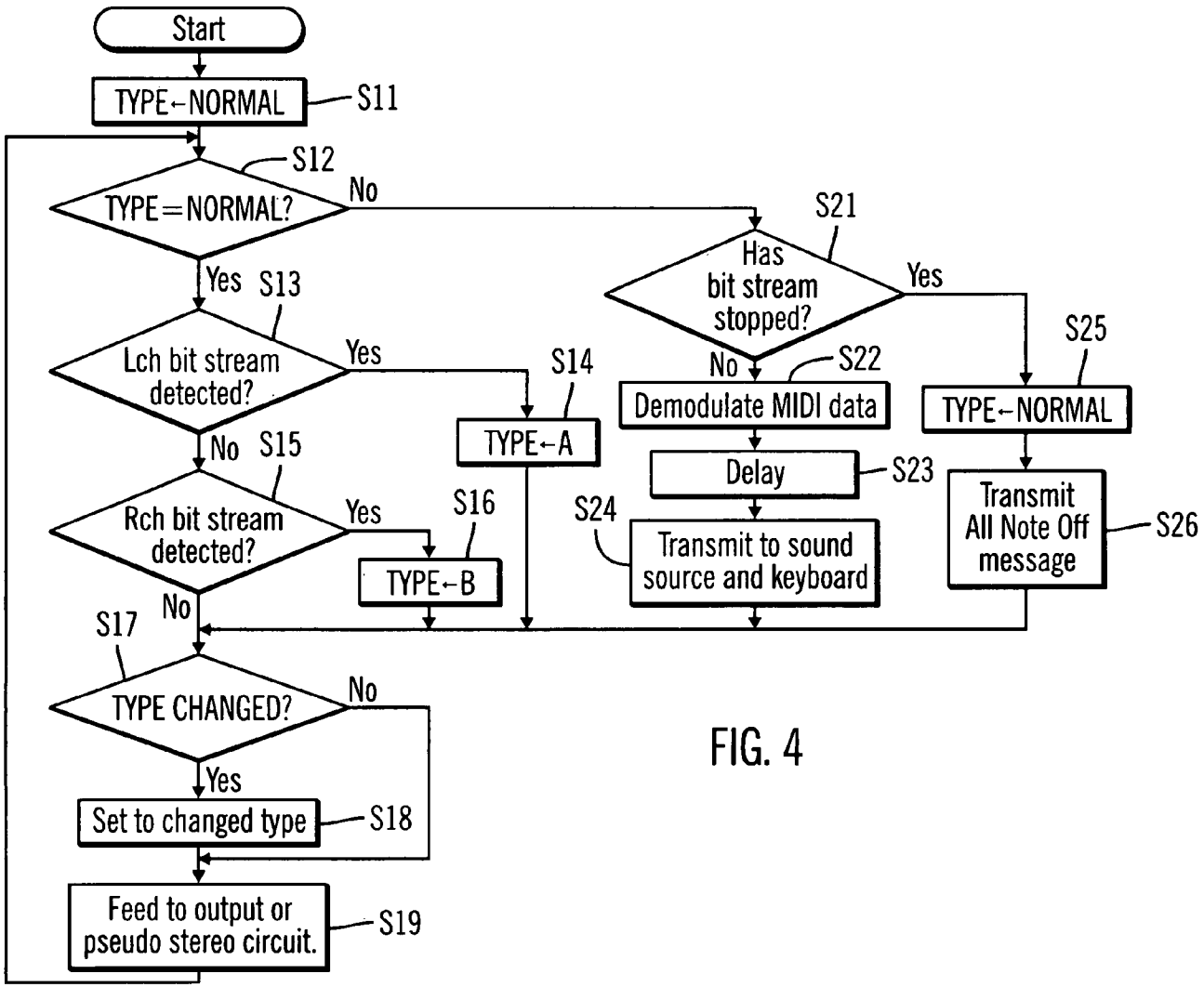
FIG. 4 is a flowchart that shows processing of an embodiment of the present invention.

FIG. 4 is a flowchart of processing that is executed by the CPU 2 from the application of electric power to the electronic instrument 1 until the power is cut off. In this flowchart, the processing regarding the normal performance mode in which the performance is done by the manual operation of the keyboard has been omitted. Only the processing of the automatic performance mode for the case in which an analog signal that has been reproduced from a CD or a DVD is input to the A/D converter 8 and the automatic performance is carried out by a digital signal that is demodulated is shown.

When electric power is applied to the electronic instrument 1, first, the type is set to Normal (S11). This type is, as has been discussed above, a type in which any of the analog signals that have been input to the left and right channels are not modulated by a digital signal. The category of the type that has been set is stored in a specified region of the RAM 4.

Next, a determination is made as to whether or not the type that is currently set is Normal (S12). In those cases where the type that is currently set is Normal (S12: yes), whether or not the analog signal of the left channel is modulated by a bit stream (a digital signal) is detected (S13). In this detection, the determination is made by whether or not the level of the analog signal is maintained for a specified period of time at a high level or a low level, then changed from the high level to a low level or from the low level to a high level, and whether or not a digital signal that indicates a "0" or a "1" has been detected.

In those cases where the result is that a bit stream has been detected in the left channel (S13: yes), the type is set to A (S14) and the routine proceeds to the processing of S17. In this embodiment of the present invention, those cases in which an analog signal of the left channel is modulated by a digital signal are judged to be type A and those cases in which, on the contrary, an analog signal of the right channel is modulated by a digital signal are judged to be type B.

In those cases where, in the processing of S13, the fact that an analog signal of the left channel is modulated by a bit stream has not been detected (S13: no), whether or not an analog signal of the right channel is modulated by a bit stream is detected (S15). Since this detection is the same as the detection for the left channel, the explanation has been omitted.

In those cases where a bit stream has been detected in the right channel (S15: yes), the type is set to B (S16) and the routine proceeds to the processing of S17. In those cases where a bit stream has not been detected in the right channel (S15: no), the processing of S16 is skipped and the routine proceeds to the processing of S17.

In the processing of S17, a determination is made as to whether or not the type that has been set has been changed this time (S17). In other words, a determination is made as to whether or not the type that is stored in a specified region of the RAM 4 has been rewritten. In those cases where the type has been changed (S17: yes), the cutover switch that is shown in FIG. 4 is set to the position that corresponds to the changed type (S18). By this processing, in those cases where an analog signal of either the left or the right channel is modulated by a digital signal, the input of the channel that differs from the channel in which the analog signal is modulated by the digital signal is input to the pseudo stereo circuit.

In those cases where, in the processing of S17, the type has not changed (S17: no), and also in those cases where the processing of S18 has finished, the amplitude value of an audio signal is fed to the output or to the pseudo stereo circuit in accordance with the cutover switch (S19) and the routine returns to the processing of S12.

On the other hand, in those cases where in the determination processing of S12 the type that is currently set is not the Normal one (S12: no), a determination is made as to whether or not the bit stream has stopped (S21). This is a case in which the reproduction of the CD and the like has ended, or a case in which an operation to stop the reproduction in the middle has been carried out and a bit stream has not been detected for a specified period of time or greater.

In those cases where the bit stream has not stopped (S21: no), the MIDI data are demodulated (demodulation) from the bit stream (S22), and after a delay of a specified period of time (S23), are transmitted to the sound source 9 and the keyboard 5 (S24). In those cases where demodulation is done, the method of demodulation is different depending on the type but here, in order to simplify the explanation, the description regarding the different processing depending on the type has been omitted. In addition, since as discussed above the delay time also is different depending on the type, the specified time that the delay is done in S23 is set for each one to a time that corresponds to the type. Also, in this flowchart, in order to simplify the explanation, a delay has been implemented in the processing of S23. In actuality, the MIDI data that have been temporarily demodulated are stored in the RAM and in those cases where the passage of a specified period of time from the time that the storage was done is detected, processing that transmits the data to the sound source 9 is carried out. In those cases where the MIDI data have been transmitted to the sound source, the routine proceeds to the processing of S17.

When the MIDI data have been transmitted, the sound source 9 and the keyboard 5 carry out processing that corresponds to the MIDI data. For example, if the MIDI data are Note On, the sound source 9 starts the production of the musical tone in conformance with the pitch and the velocity that are indicated by the Note On and if the data are Note Off, the musical tone having the pitch that is indicated by the Note On is canceled. In addition, for the keyboard 5, if the MIDI data are Note On, electrical power is applied to the solenoid 5*a* that corresponds to the key of the pitch that is indicated by the Note On and the key is pressed down. If the data are Note Off, the power that is being supplied to the solenoid 5*a* that corresponds to the key of the pitch that is indicated by the Note Off is cut off and the key is released. In those cases where the key is driven by the solenoid 5*a* and a key pressing or key releasing has been detected by the switch with which the key is furnished, the action of the switch is ignored and the transmission of the Note On and the Note Off to the sound source 9 is not carried out.

In those cases where in the processing of S21 it has been determined that the bit stream has stopped (S21: yes), the type is made Normal (S25), an All Note Off, which is a MIDI message for stopping the musical tones that are currently being produced by the sound source 9, is transmitted (S26), and the routine proceeds to the processing of S17.

Figure 5:
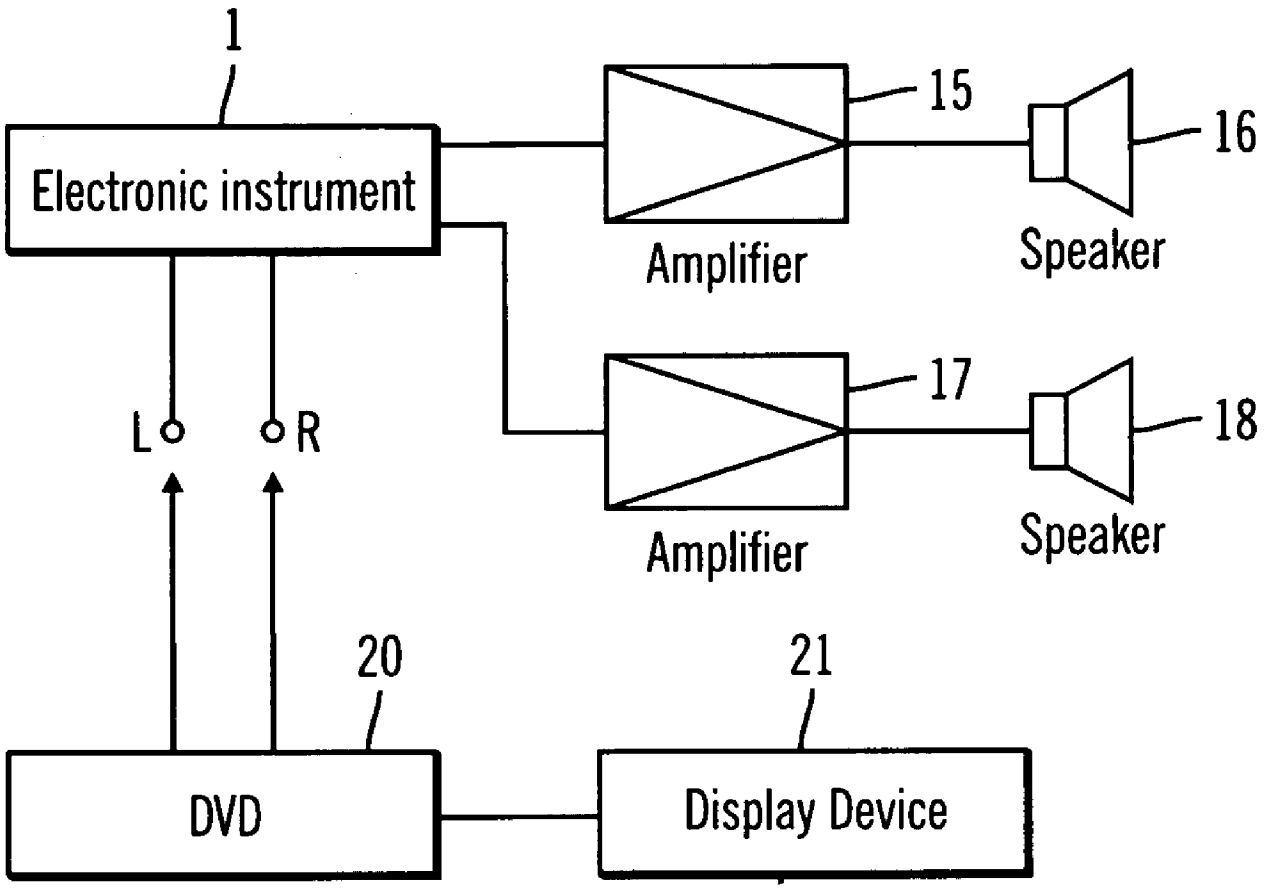
FIG. 5 is a block diagram that shows a system configuration where the reproducing apparatus that inputs to the electronic instrument is a DVD reproducing apparatus according to an embodiment of the present invention.

FIG. 5 is a block diagram that shows an overview of a system that includes the electronic instrument 1 described above. The DVD playback device 20 is used as the reproducing apparatus and the audio signals of the left and right channels that are reproduced by the DVD playback device 20 are input to the electronic instrument 1, while the image signal that is reproduced by the DVD playback device 20 is input to the display 21. The audio outputs of the left and right channels of the electronic instrument 1 are respectively output to the amps 15 and 17, and the outputs of each of the amps 15 and 17 are respectively connected to the speakers 16 and 18.

The MIDI data are modulated and stored in either the left or the right audio track channel of the DVD that is reproduced by the DVD playback device 20. The musical tone accompaniment that is generated by MIDI data is stored in the channel that is different from this channel and another audio channel. The images that have been synchronized with these pieces of music are stored in an image track. When the DVD is reproduced, the musical tones are formed synchronized with the images that are projected on the display device 21 from the electronic instrument 1 and, together with this, the keys of the electronic instrument 1 are driven. Accordingly, since the images on the display 21 and the movement of the keys of the electronic instrument 1 are synchronized with the reproduction of the DVD and the musical tones are formed and synchronized with these movements, it is possible to enjoy the performance visually and audibly.

As has been explained above, whether or not an analog signal that has been input in either the left or right channel is modulated by a digital signal is detected, and in those cases where an analog signal is modulated by a digital signal, the digital signal is demodulated and converted into MIDI data, controlling the sound source 8. On the other hand, the analog signal of the channel that is not the one in which the analog signal is modulated by the digital signal is made into a pseudo stereo signal and output. Therefore, it is not necessary for the user to perform an operation such as to set by which of the left and right input signals the analog signal is modulated by the digital signal and it is possible to improve the operability.

Incidentally, the processing of S22 of the flowchart shown in FIG. 4 corresponds to the demodulation means, the processing of S24 corresponds to the feed means, the processing of S13 and S15 correspond to the detection means, and the processing of S19 and S22 correspond to the control means.

In addition, the processing of S23 of the flowchart shown in FIG. 4 corresponds to the delay device.

An electronic instrument according to an embodiment of the present invention includes a detection device that detects whether or not any of the audio signals of the plurality of channels that has been input by the input device is modulated by the digital signals that control the electronic instrument. A control device controls the demodulation device when the detection device detects that any of the audio signals of the plurality of channels that has been input by the input device is modulated by the digital signals that control the electronic instrument. The digital signals that control the electronic instrument are demodulated from the audio signals that have been input to the channels, such that another channel's audio signals that are not modulated by the digital signals are output to an audio output.

Therefore, there is the advantageous result that the operability is satisfactory without the need to indicate whether the audio signal that is input is modulated by the digital signal that controls the electronic instrument.

According to an embodiment of the present invention, the audio signal that is input by the input device is an analog signal and the detection device differentiates the type of the digital signal by detecting which of the channels the analog signals that have been input by the input device is modulated by the digital signals. The demodulation device demodulates the digital signal based on the type of digital signal that has been differentiated by the detection device.

The digital signals that modulate the analog signal differ in such factors as in which of the plurality of channels the analog signal is modulated by the digital signal, the pulse width of the analog signal, the storage format for the MIDI data, and the like. Therefore, there is the advantageous result that when in which of the plurality of channels the analog signal is modulated by the digital signal is detected, it is possible to differentiate the type of the digital signal and, because of this, the processing for the demodulation of the digital signal becomes simple.

According to another embodiment of the present invention, the audio signal that is input by the input device is an analog signal and in cases where the detection has detected that any of the plurality of analog signals that have been input by the input device is modulated by a digital signal, the detection device differentiates the type of digital signal by detecting a width of the pulse that forms the waveform of the analog signal. The demodulation device demodulates the digital signal based on the type of digital signal that has been differentiated by the detection device.

In those cases where it has been set up such that when the fact that an analog signal is modulated by a digital signal in either the left or the right channel has been detected and the type is detected in conformance with the channel, there are instances in which, if the user has made a mistake and connected the left and right erroneously, the correct demodulation is not possible. However, if the type of the digital signal is differentiated by the width of the pulse, there is the advantageous result that even if the user connects the left and the right erroneously, correct demodulation and reproduction is possible.

According to a further embodiment to the present invention, the audio signals that are input by the input device are two, a left and a right, channel audio signals. The instrument includes a pseudo stereo device with which either the left or the right audio signal that has been input by the input device is converted into a pseudo stereo signal. In cases where the fact that the detection device has detected that either the right or the left channel that has been input by the input device is modulated by a digital signal that controls the electronic instrument, the control device feeds the audio signal of a channel that is different from the channel in which the analog signal is modulated by the digital signal to the pseudo stereo device.

Therefore, since in those cases where the signal that has been input to either the left or right channel is one that is modulated by the digital signal, the analog signal that is not the analog signal modulated by the digital signal is a monaural signal, it is possible to convert the signal into a pseudo stereo signal and there is the advantageous result that a musical tone having a satisfactory sound can be obtained.

According to an embodiment of the present invention, the control device includes a delay device with which a digital signal that has been demodulated by the demodulation device is delayed a specified period of time and fed to the sound source.

With the digital signal that controls the electronic instrument, which is stored on the CD and the like, it is presumed that the keys of an acoustic piano are driven and due to the fact that the keys are pressed down, strings are struck and musical tones are produced. Accordingly, the electronic instrument requires time (for example, 500 msec) from when the digital signal is input until the musical tone is formed. In those cases where a tune that performs an accompaniment is recorded on the other channel and in those cases where images that have been synchronized with the tune are stored, since the musical tones that are produced from the digital signal are delayed, musical tones are stored the amount of the delay early.

Since in the case of a sound source that can produce the musical tones immediately when the digital signal is input without a key being pressed down and carrying out the striking of the string that corresponds to the key, this delay is not produced, there is the advantageous result that it is possible to synchronize and reproduce the tune that is reproduced from the other channel and the images by delaying the digital signal.

According to an embodiment of the present invention, the detection device differentiates the type of digital signal by detecting which of the channels of the plurality of channels the audio signal that has been inputed by the input device is modulated by the digital signal. In cases where the detection device has detected that any of the audio signals of the plurality of channels that have been input by the input device is modulated by a digital signal, the detection device differentiates the type of the digital signal by the width of the pulse that forms the waveform of the audio signal. The delay for a specified period of time and feed to the sound source is done by the delay device in conformance with the type of digital signal, which has been demodulated by the demodulation device that has been differentiated by the detection device.

Therefore, the delay time is set in conformance with the type of digital signal that modulates the audio signal that has been input by the input device, and there is the advantageous result that it is possible to synchronize and reproduce the tune that is reproduced from the other channel and the images.

According to an embodiment of the present invention the electronic instrument includes a key driving device that drives a plurality of keys. The control device carries out control such that the key is driven by the key driving device in conformance with the digital signal that controls the electronic instrument and which has been demodulated by the demodulation device. There is the advantageous result that the keys of the keyboard are synchronized with the musical tones that are produced by the electronic instrument and it is possible to visually enjoy the performance.

A reproduction system according to an embodiment of the present invention includes a reproducing apparatus that synchronizes and reproduces an audio signal and an image signal and an electronic instrument. The electronic instrument includes an input device by which an audio signal that is reproduced by the reproducing apparatus is input. The electronic instrument also includes a demodulation device that demodulates a digital signal that controls the electronic instrument and which modulates the audio signal that has been input by the input device and a sound source that forms a musical tone signal in conformance with the digital signal that has been demodulated by the demodulation device. A sound apparatus is provided that emits the musical tone signal that is formed by the electronic instrument and the audio signal that is reproduced by the reproducing apparatus. A display apparatus displays the image signal that is reproduced by the reproducing apparatus.

Therefore, there is the advantageous result that the images that are reproduced by the reproduction system and the musical tones that are produced by the electronic instrument are synchronized and it is possible to enjoy a visual and auditory presentation.

According to one embodiment of the present invention, the electronic instrument also includes an input device that inputs the audio signals of a plurality of channels from the reproducing apparatus. This embodiment further includes a detection device with which whether or not any of the audio signals of the plurality of channels that have been input by the input device are modulated by the digital signals that control the electronic instrument is detected. A control device is provided that controls the demodulation device when it has been detected by the detection device that any of the audio signals of the plurality of channels that has been input by the input device is modulated by the digital signals that control the electronic instrument, so as to demodulate the digital signals that control the electronic instrument from the audio signals that have been input to the channels, such that another channel's audio signals that are not modulated by the digital signals are output to an audio output. Therefore, there is the advantageous result that operability is satisfactory without the necessity for providing an instruction to the electronic instrument as to whether a signal that is input is modulated by a digital signal that controls the electronic instrument is input.

According to an embodiment of the present invention the audio signal that is input by the input device is an analog signal, and the detection device differentiates the type of digital signal by detecting which of the channels the analog signal that has been input by the input device is modulated by the digital signal. The demodulation device demodulates the digital signal based on the type of digital signal that has been differentiated by the detection device.

Therefore, there is the advantageous result that when in which of the channels of the plurality of channels the analog signal is modulated by the digital signal is detected, it is possible to differentiate the type of the digital signal and, because of this, the processing for the demodulation of the digital signal becomes simple.

According to another embodiment of the present invention, the audio signal that is input by the input device is an analog signal. In those cases where the detection device has detected that any of the plurality of analog signals that have been input by the input device is modulated by the digital signal, the detection device differentiates the type of digital signal by detecting the width of the pulse that forms the waveform of the analog signal, and the demodulation device demodulates the digital signal based on the type of digital signal that has been differentiated by the detection device.

In those cases where it has been set up such that when the fact that an analog signal is modulated by a digital signal in either the left or right channel has been detected and the type is detected in conformance with the channel, there are instances in which, if the user has made a mistake and connected the left and right erroneously, the correct demodulation is not possible. However, if the type of the digital signal is differentiated by the width of the pulse, there is the advantageous result that even if the user connects the left and the right erroneously, correct demodulation and reproduction is possible.

According to a further embodiment of the present invention, the audio signals that are input by the input device are two, a left and a right, channel audio signals and a pseudo stereo device with which either the left or the right audio signal that has been input by the input device is converted into a pseudo stereo signal. In those cases where the fact that either the left or the right audio signal that has been input by the input device is modulated by a digital signal that controls the electronic instrument has been detected by the detection device, the control device feeds the audio signal of a channel that is different from the channel in which the analog signal is modulated by the digital signal to the pseudo stereo device. Therefore, since in those cases where the signal that has been input to either the left or right channel is one that has been modulated by the digital signal, the analog signal that is not the analog signal that has been modulated by the digital signal is a monaural signal, it is possible to convert the signal into a pseudo stereo signal and there is the advantageous result that a musical tone having a satisfactory sound can be obtained.

According to an embodiment of the present invention, the electronic instrument includes a delay device with which a digital signal that has been demodulated by the demodulation device is delayed a specified period of time and fed to the sound source. As discussed above, since the digital signal that controls the electronic instrument, which is stored on a CD and the like, is stored early with respect to the accompaniment that is recorded on the other channel and the images, there is the advantageous result that it is possible to synchronize and reproduce the tune that is reproduced from the other channel and the images by delaying the digital signal that controls the electronic instrument.

According to an embodiment of the present invention the detection device differentiates the type of the digital signal by detecting which of the channels of the plurality of channels the audio signal that has been input by the input device is modulated by the digital signal. In those cases where the detection device has detected that any of the audio signals of the plurality of channels that have been input by the input device is modulated by a digital signal, the detection device differentiates the type of digital signal by a width of the pulse that forms the waveform of the audio signal. The delay for a specified period of time and feed to the sound source is performed by the delay device in conformance with the type of digital signal, which has been demodulated by the demodulation device, that has been differentiated by the detection device. Therefore, the delay time is set in conformance with the type of digital signal that modulates the audio signal that has been input by the input device, and there is the advantageous result that it is possible to synchronize and reproduce the tune that is reproduced from the other channel and the images.

According to a further embodiment of the present invention the electronic instrument comprises a plurality of keys and a keyboard driving device driving each of the plurality of keys in conformance with the digital signals that control the electronic instrument. There is the advantageous result that the keys of the keyboard are driven synchronized with the musical tones that are produced by the electronic instrument and the images that are reproduced by the reproduction system and it is possible to visually enjoy the performance.

An explanation was given above of the present invention based on several embodiments, however, the present invention is one that is in no way limited to the preferred embodiments described above and the fact that various modifications and changes are possible that do not deviate from and are within the scope of the essentials of the present invention can be easily surmised.

For example, in one embodiment described above, the electronic instrument 1 is one that has the keyboard 5 built in. However, the keyboard apparatus may also be made as a separate unit and it may be set up such that the performance data are transmitted from the keyboard apparatus to the electronic instrument 1 or from the electronic instrument 1 to the keyboard apparatus using a communications format that complies with the MIDI standard.

In addition, in another embodiment described above, it has been set up such that the left and right analog signals are input to the A/D converter 8 from a CD or DVD reproducing apparatus that has been connected externally. However, it may also be set up such that an audio digital signal is input from the reproducing apparatus and the digital signal that controls the electronic instrument is demodulated from the digital signal.

In addition, a further embodiment described above, it has been set up such that in which of the left and right channels the analog signal is modulated by the digital signal is detected and the differentiation of the type of digital signal is done in accordance with the channel that has been detected. However, it may also be set up such that the width of the pulse of the input signal that indicates a "0" or a "1" is detected, and the differentiation of the type of digital signal is done by the width of the pulse. As discussed above, since the width of the pulse that indicates a "0" or a "1" is different depending on the type and, together with this, the format of the MIDI data is also different, it would be possible to accurately demodulate the MIDI data in accordance with the differentiation of the type.

In addition, in one embodiment described above, it has been set up such that the sound source 9 is furnished built into the electronic instrument 1. However, it may also be set up such that an output device to which the MIDI data are output is furnished, the output device is connected to an external sound source, and the musical tones are produced by the external sound source.

What is claimed:

1. An electronic instrument, comprising:

input means for inputting an audio signal, the input means having a plurality of channels to each of which the audio signal is input;

demodulation means for demodulating audio signals that have been input by the input means and converting the audio signals into digital signals that control the electronic instrument;

feed means for feeding the digital signals that have been demodulated by the demodulation means to a sound source;

detection means for detecting whether or not any of the audio signals of the plurality of channels that have been input by the input means are modulated by the digital signals that control the electronic instrument; and control means for controlling the demodulation means, in cases where it has been detected by the detection means that any of the audio signals of the plurality of channels that have been input by the input means are modulated by the digital signals that control the electronic instrument, so as to demodulate the digital signals that control the electronic instrument from the audio signals that have been input to the channels, such that a second channel's audio signals that are not modulated by the digital signals are output to an audio output;

wherein the control means includes delay means for delaying a digital signal that has been demodulated by the demodulation means a specified period of time and fed to the sound source; and wherein the detection means differentiates a type of digital signal by detecting which of the audio signals of the plurality of channels that have been input by the input means are modulated by the digital signal, and in cases where the detection means has detected that any of the audio signals of the plurality of channels that have been input by the input means are modulated by the digital signal, the detection means differentiates a type of digital signal by detecting a width of a pulse that forms a waveform of the audio signal, and wherein the delay for a specified period of time and feed to the sound source is performed by the delay means 1) on the signal that has been detected by the detection means to have been modulated by the digital signals that control the electronic instrument at the time the signal was input by the input means to one of the plurality of channels, and 2) in conformance with the type of digital signal, which has been demodulated by the demodulation means, and that has been differentiated by the detection means.

2. The electronic instrument according to claim 1, wherein the audio signal that is input by the input means is an analog signal, the detection means differentiates a type of digital signal by detecting which of the analog signals of the plurality of channels that have been input by the input means are modulated by the digital signals, and the demodulation means demodulates the digital signals based on the type of digital signal that has been differentiated by the detection means.

3. The electronic instrument according to claim 1, wherein the audio signal that is input by the input means is an analog signal, in cases where the detection means detects that any of the analog signals of the plurality of channels that have been input by the input means are modulated by the digital signals, the detection means differentiates a type of digital signal by the detection of a width of a pulse that forms a waveform of the analog signal, and the demodulation means demodulates the digital signals based on the type of digital signal that has been differentiated by the detection means.

4. The electronic instrument according to claim 1, wherein the audio signals that are input by the input means are two, a left and a right, channel audio signals, the electronic instrument includes pseudo stereo means for converting either a left or a right audio signal that has been input by the input means into a pseudo stereo signal, and in cases where the detection means has detected that either the left or the right audio signal that has been input by the input means is modulated by the digital signal that control the electronic instrument, the control means feeds the audio signal of a channel that is different from the channel in which the audio signal is modulated by the digital signal to the pseudo stereo means.

5. The electronic instrument according to claim 1, wherein the digital signals that control the electronic instrument comprise MIDI data.

6. The electronic instrument according to claim 1, wherein the electronic instrument is furnished with a plurality of keys and key driving means for driving each key, and the control means carries out control such that the key is driven by the key driving means in conformance with the digital signal that controls the electronic instrument and which has been demodulated by the demodulation means.

7. A method for an electronic instrument, comprising:

inputting an audio signal into a plurality of channels;

demodulating the audio signals and converting the audio signals into digital signals that control the electronic instrument;

feeding the demodulated digital signals to a sound source;

detecting whether or not any of the audio signals of the plurality of channels are modulated by the digital signals; and controlling demodulation in cases where it has been detected that the any of the audio signals of the plurality of channels are modulated by the digital signals, so as to demodulate the digital signals from the audio signals, such that a second channel's audio signals that are not modulated by the digital signals are output to an audio output;

wherein the controlling includes delaying a digital signal that has been demodulated by a specified period of time and feeding to the sound source; and wherein the detecting comprises differentiating a type of digital signal by determining which of the audio signals of the plurality of channels that have been input are modulated by the digital signal, and in cases where any of the audio signal of the plurality of channels that have been input by the input means are detected to have been modulated by the digital signal, the detecting differentiates a type of digital signal by detecting a width of a pulse that forms a waveform of the audio signal, and wherein the delaying for a specified period of time and feeding to the sound source is 1) on the signal that has been detected to have been modulated by the digital signals at the time the signal was input to one of the plurality of channels, and 2) in conformance with the type of digital signal which has been demodulated and differentiated by detecting.

8. The method according to claim 7, wherein inputting an analog signal as the audio signal, differentiating a type of digital signal by detecting which of the analog signals of the plurality of channels are modulated by the digital signals; and demodulating the digital signals based on the type of digital signal that has been differentiated.

9. The method of electronic instrument according to claim 7, further comprising:

inputting an analog signal as the audio signal;

differentiating a type of digital signal by the detection of a width of a pulse that forms a waveform of the analog signal when it has been detected that any of the analog signals of the plurality of channels are modulated by the digital signals, and demodulating the digital signal based on the type of digital signal that has been differentiated.

10. The method of electronic instrument according to claim 7, wherein the plurality of channels into which audio signals are input, include a left channel and a right channel, and wherein the method further comprises:

converting either a left or a right audio signal into a pseudo stereo signal, and in cases where either the left or the right channel audio signal has been detected to have been modulated, feeding for converting to pseudo stereo the audio signal of a channel that is different from the channel in which the audio signal is modulated.

11. The method according to claim 7, wherein the digital signals that control the electronic instrument comprise MIDI data.

* * * * *